US011509982B2

(12) United States Patent
Ellis et al.

(10) Patent No.: US 11,509,982 B2
(45) **Date of Patent: *Nov. 22, 2022**

(54) AUDIO DEVICE MOUNT ASSEMBLY

(71) Applicant: Biamp Systems, LLC, Beaverton, OR (US)

(72) Inventors: Vincent William Ellis, Hillsboro, OR (US); William John Done, Portland, OR (US)

(73) Assignee: Biamp Systems, LLC, Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/228,619

(22) Filed: Apr. 12, 2021

(65) Prior Publication Data

US 2021/0235175 A1 Jul. 29, 2021

Related U.S. Application Data

(63) Continuation of application No. 16/778,125, filed on Jan. 31, 2020, now Pat. No. 10,979,791.

(60) Provisional application No. 62/801,053, filed on Feb. 4, 2019.

(51) Int. Cl.
*H04R 1/02* (2006.01)

(52) U.S. Cl.
CPC ..... *H04R 1/025* (2013.01); *H04R 1/026* (2013.01); *H04R 2201/021* (2013.01)

(58) Field of Classification Search
CPC ... H04R 1/025; H04R 1/026; H04R 2201/021
See application file for complete search history.

(56) References Cited

U.S. PATENT DOCUMENTS

| | | | | |
|---|---|---|---|---|
| 1,964,448 | A | 6/1934 | Jasper | |
| 2,195,651 | A | 4/1940 | Holliday | |
| 4,984,278 | A | 1/1991 | Frye et al. | |
| 5,734,732 | A | 3/1998 | Lemmon | |
| 6,707,925 | B1 | 3/2004 | Breithaupt | |
| 7,346,181 | B2 | 3/2008 | Rivera | |
| 7,856,114 | B2 | 12/2010 | Belanger et al. | |
| 10,182,279 | B1 | 1/2019 | Zhou et al. | |
| 10,312,651 | B2 | 6/2019 | Lai et al. | |
| 10,979,791 | B2 * | 4/2021 | Ellis | H04R 1/025 |
| 2010/0316245 | A1 | 12/2010 | Mishra et al. | |
| 2014/0064534 | A1 | 3/2014 | Stewart, Jr. et al. | |
| 2015/0271583 | A1 | 9/2015 | Wan | |
| 2016/0261824 | A1 | 9/2016 | Scalisi | |
| 2017/0264999 | A1 | 9/2017 | Fukuda et al. | |
| 2017/0289662 | A1 | 10/2017 | Hannath et al. | |
| 2018/0231240 | A1 | 8/2018 | Roca et al. | |
| 2019/0014400 | A1 | 1/2019 | Claerbout et al. | |
| 2020/0018469 | A1 | 1/2020 | Kohen | |
| 2020/0252704 | A1 | 8/2020 | Ellis et al. | |

* cited by examiner

*Primary Examiner* — Andrew L Sniezek

(57) ABSTRACT

Example embodiments provide a device that includes a support plate having a flat base portion and an elongated portion which extends perpendicular to the flat base portion, and a housing embodying one or more of a microphone and a speaker, and a housing backside having a set of screw holes configured to receive a set of screws to secure the support plate flat base portion to be flush mounted against the housing.

4 Claims, 8 Drawing Sheets

AUDIO DEVICE MOUNT ASSEMBLY

FIELD OF INVENTION

This application relates to a securing mechanism for audio devices and more specifically to an audio device mount assembly.

BACKGROUND OF THE INVENTION

Certain electrical devices, which are hung from the ceiling or placed on a table, such as audio products (e.g., speakers, microphones, etc.) and other industry products associated with a conference room or similar type of working space, may require an expert installation due to safety and related integrity concerns. Microphones and speakers are usually placed on a table-top without any professional installation. Additionally, the relative ease of installation is always a concern. The more complicated the product is to install the less likely the product is to be purchased and implemented by customers.

SUMMARY OF THE INVENTION

The present application relates to a device that includes a support plate with a flat base portion and an elongated portion which extends perpendicular to the flat base portion, and a housing embodying one or more of a microphone and a speaker, a housing backside comprises a set of screw holes configured to receive a set of screws to secure the support plate flat base portion to be flush mounted against the housing.

Another example embodiment may include a device with a housing backplate affixed to a housing which embodies one or more of a speaker and a microphone, a threaded channel affixed to the housing and extending perpendicular from the housing backplate, and a wall mount fitting with one or more securing tabs to hold the wall mount fitting to a wall mount plate.

DETAILED DESCRIPTION

Example embodiments include housing configurations for a securing mechanism for an electrical device, such as a microphone and/or speaker. In one example, the configuration provides a securing mechanism to install the device to a table-top surface. In another example, another securing mechanism provides a configuration to install the device to a wall or ceiling surface, such as a suspended ceiling, but also a drywall ceiling or wall in another example embodiment.

Figure 1:
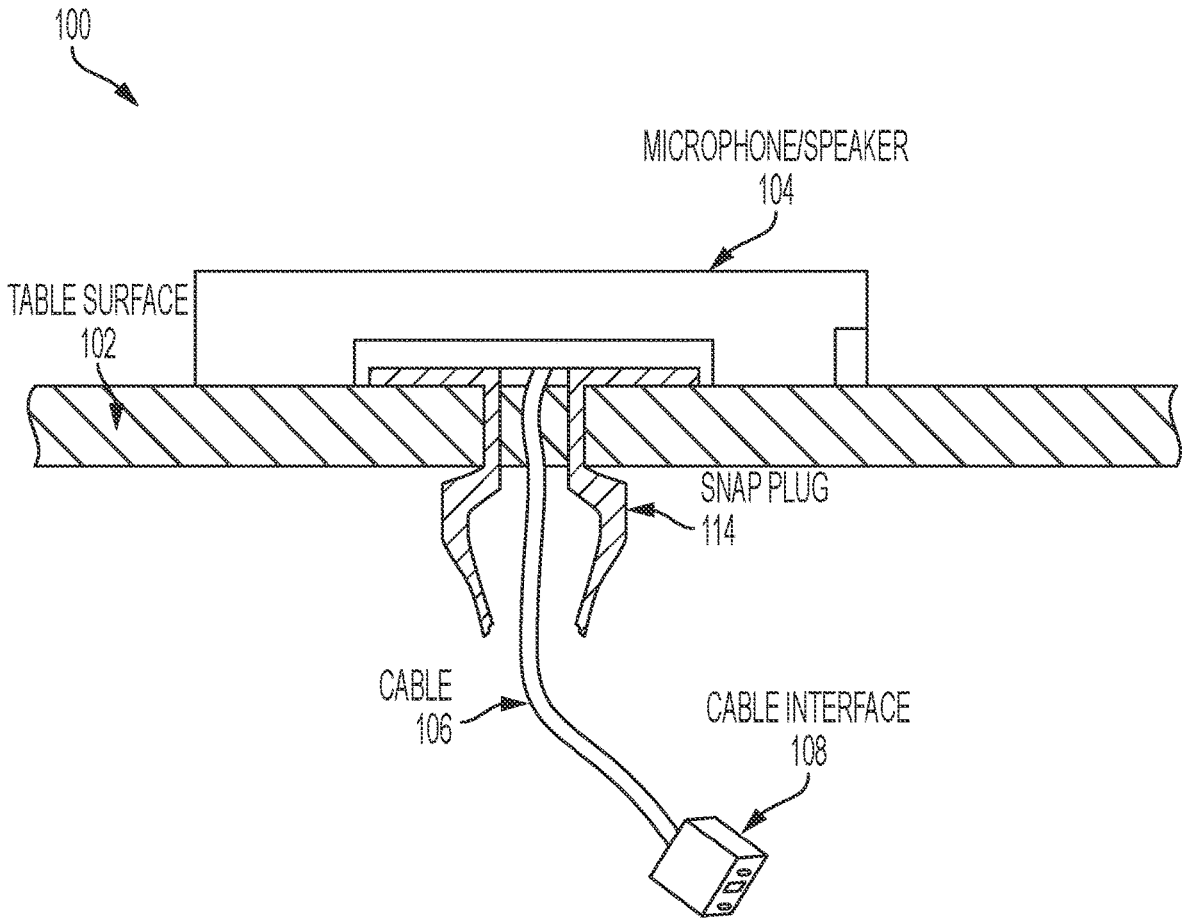
FIG. 1 illustrates a side view perspective of a device installed on a table-top surface according to example embodiments.

FIG. 1 illustrates a side view perspective of a device installed on a table-top surface according to example embodiments. Referring to FIG. 1, the configuration 100 demonstrates a device, such as a microphone, speaker or combination microphone/speaker 104 affixed to a table-top surface 102 via a snap plug 114 affixing mechanism that is screwed onto a back portion of the device housing and which has snap arms which can be deformed and moved into a secure position. The cable 106 may be attached to the microphone/speakers such that the wires in the cable are providing power and/or audio signals to the device components and are organized into a twisted pair of cables which feed into a cable interface 108, such as a RJ-11 or RJ-45 cable. This configuration may instead include a screw, rachet or O-ring type of plug as opposed to a snap ring configuration. The attachment that is affixed to the device housing may provide a quick and simple process for installing the device to the table-top.

Figure 2:
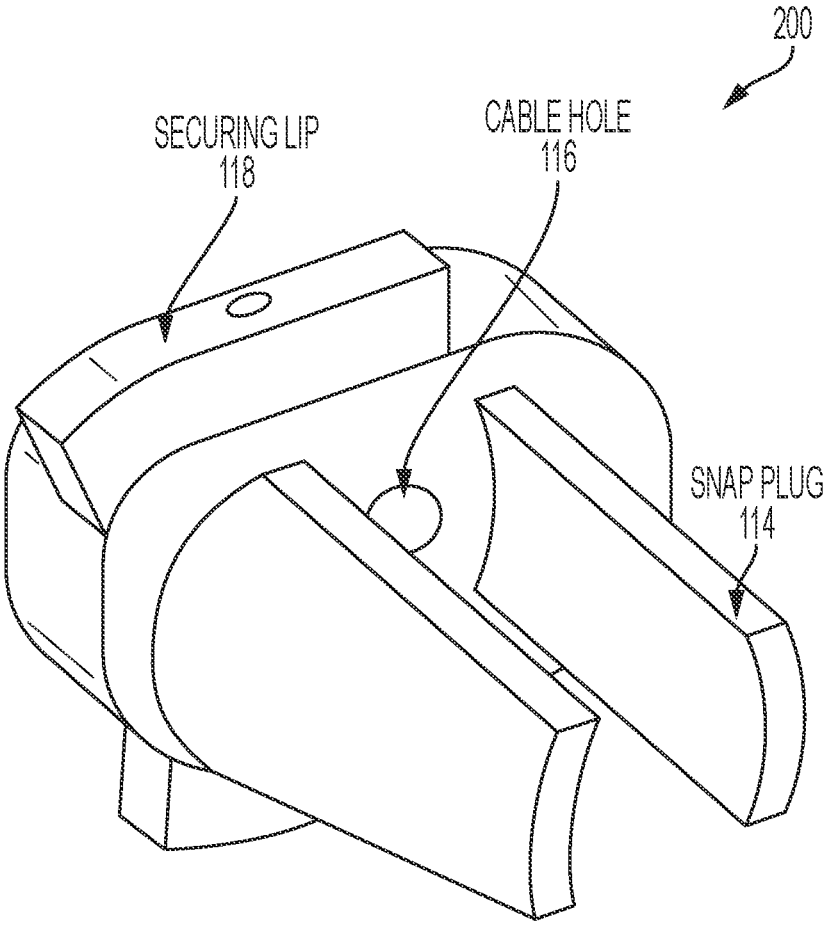
FIG. 2 illustrates a close-up view of a snap plug configuration used to mount the device to a table-top surface according to example embodiments.

FIG. 2 illustrates a close-up view of a snap plug configuration used to mount the device to a table-top surface according to example embodiments. Referring to FIG. 2, the configuration 200 provides a close-up view of the attachment used to affix the device to the table-top. The snap-plug 114 may include a cable hole 116 for the cable to pass-through and a securing lip 118 which may be engaged via a quarter turn lock rotation into a receiving end of the device housing.

Figure 3:
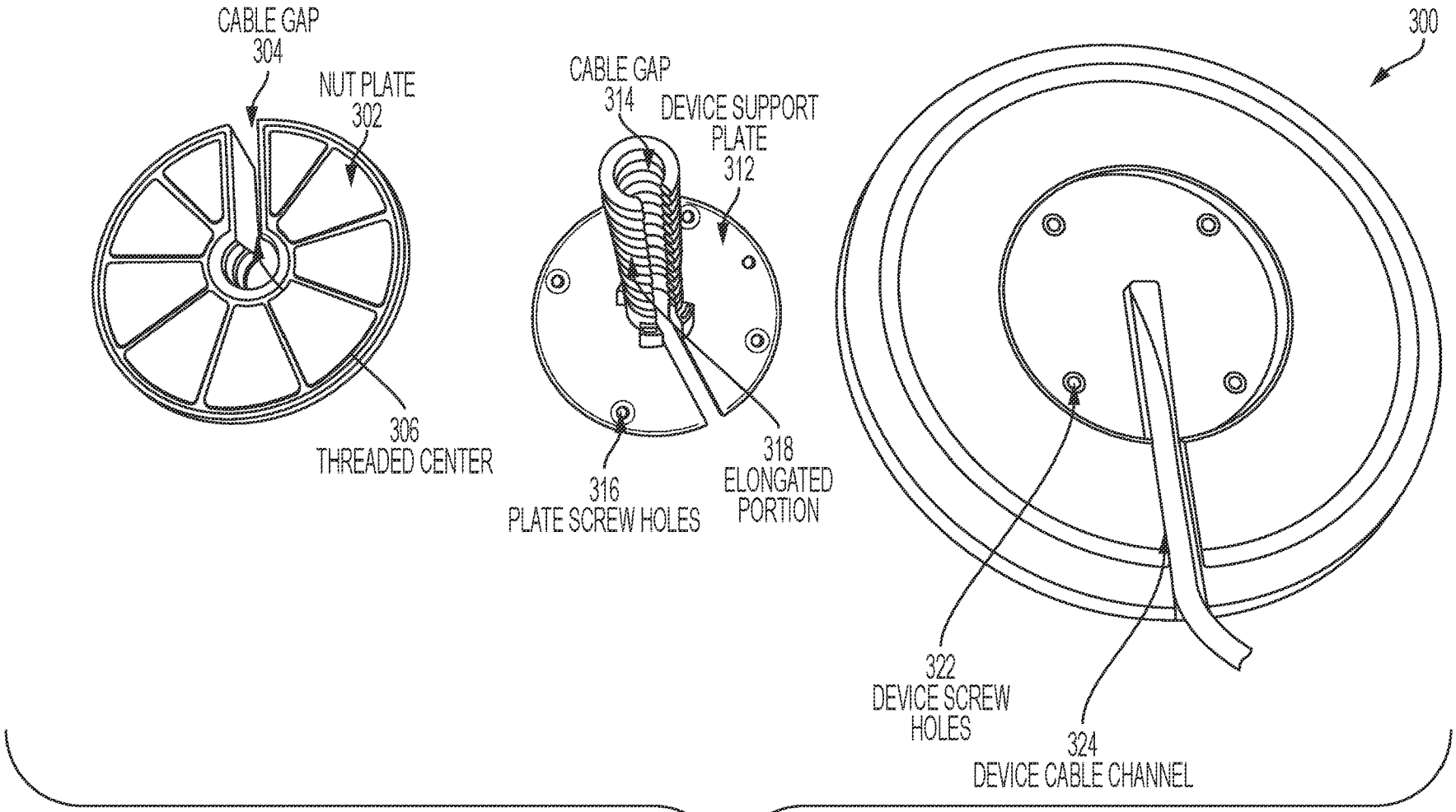
FIG. 3 illustrates an alternative table-top device mount configuration according to example embodiments.

FIG. 3 illustrates an alternative table-top device mount configuration according to example embodiments. In this configuration 300, the device is illustrated as being upside down with a circular receiving plate recessed into the housing which has a channel 324 for the cable and a set of screw holes 322 to receive screws to bind the support plate 312 with its threaded elongated portion 318 and corresponding cable gap 314. The plate may have corresponding screw holes 316 as well to match the screw holes 322 of the device. The nut plate 302 is a nut with a larger flatter surface area and may include a cable gap 304 to match the cable gap 314 of the support plate 312, and may also include a threaded center 306. When in a working position, the device plate 312 may be affixed to the device and may have the elongated portion 318 pointed downward through a hole in the table-top and the nut plate 302 may be wound onto the elongated portion until a secure position is achieved. The cable may flow from the device through the support plate 312 and nut plate 302 for optimal management and setup.

Figure 4:
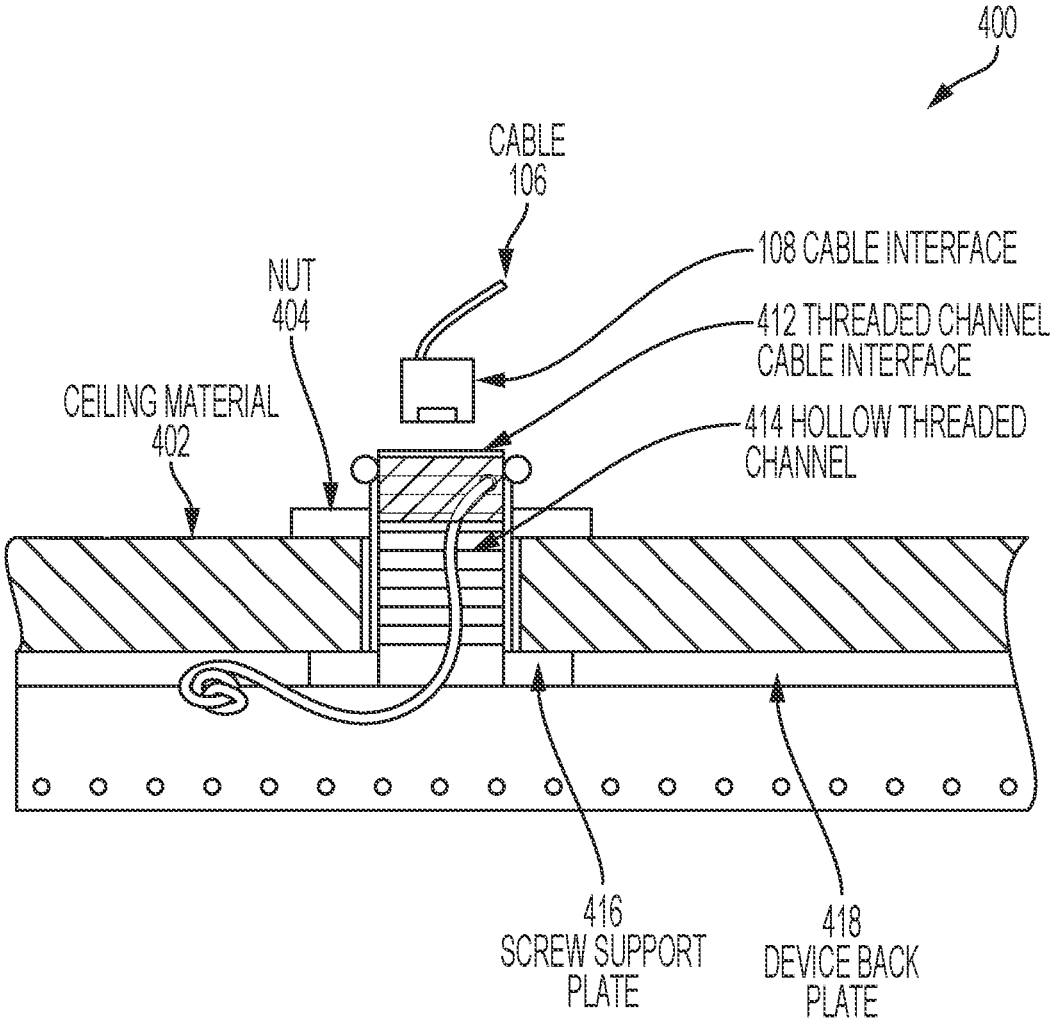
FIG. 4 illustrates a ceiling device mount configuration according to example embodiments.

FIG. 4 illustrates a ceiling device mount configuration according to example embodiments. In this configuration 400, the wall or ceiling material 402 may have a hole where the threaded channel 414 can pass-through to mount the device firmly against a wall or ceiling surface. The device may be affixed to the ceiling or wall via a nut 404 that engages the threading 412 of the hollow channel 414. The device may be wired to a cable with a cable interface that is hardwired to the center of the channel via an external cable 106 having a cable interface 108. The device backplate 418 may provide a surface with a center portion that is recessed to meet flush with the screw support plate 416. This configuration is optimal for a rack on a suspended hanging ceiling.

Figure 5:
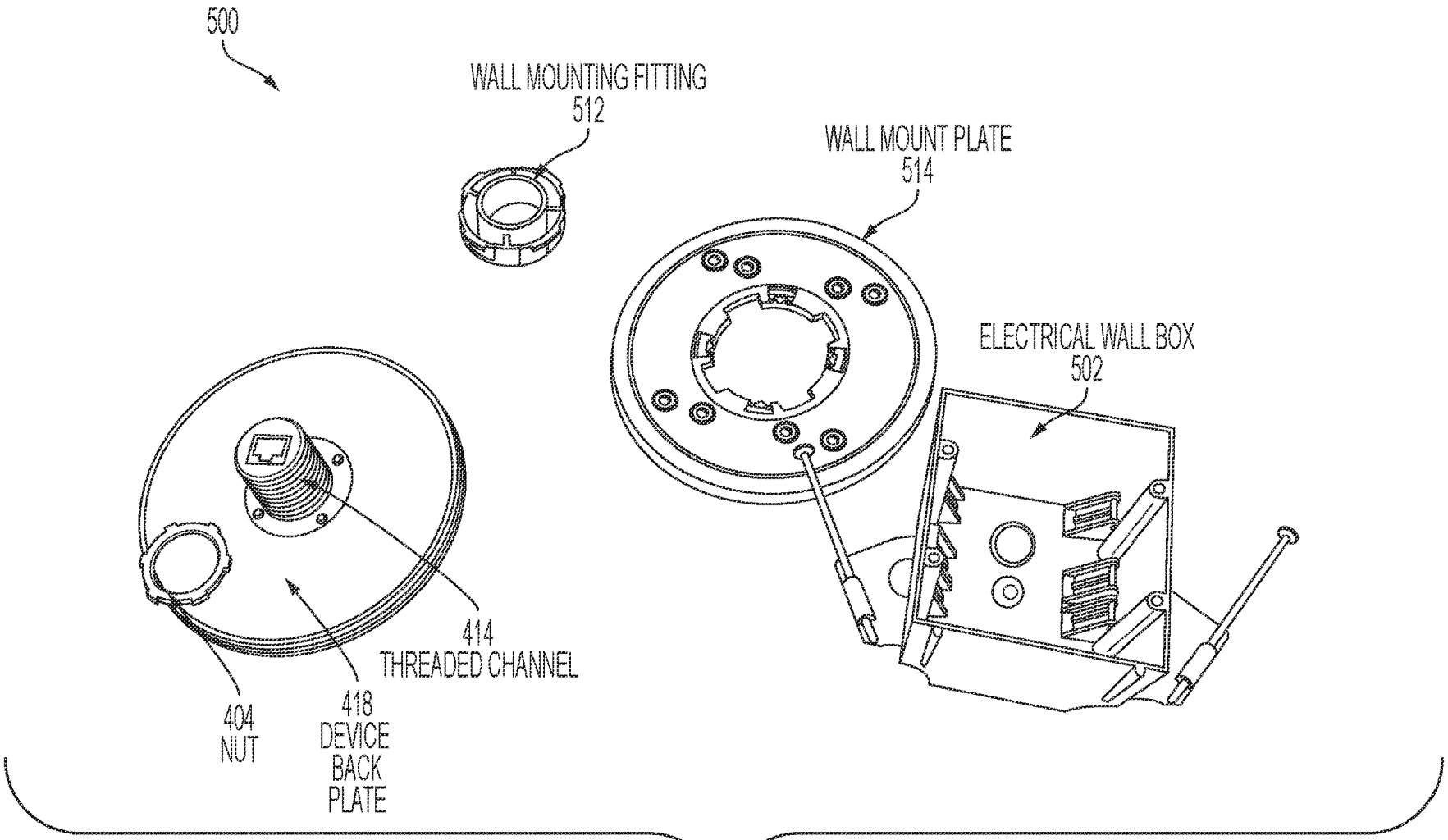
FIG. 5 illustrates a separated component view of the ceiling mount configuration using a wall mount plate according to example embodiments.

FIG. 5 illustrates a separated component view of the ceiling mount configuration using a wall mount plate according to example embodiments. Referring to FIG. 5, the configuration 500 provides a separate view of the various components used when affixing the device to drywall with an electrical wall box 502 that is affixed to a wall beam. The device may include the device back plate 418 of the device housing with the threaded channel 414 affixed to the plate via screws. The threaded channel may have a hardwired cable interface positioned flush with the top surface of the channel to receive a cable from an external source. The nut 404 provides a way to hold the wall mounting fitting 512 into position so the wall mount plate 514 can be engaged with the wall mounting fitting while be affixed to the wall box 502.

Figure 6:
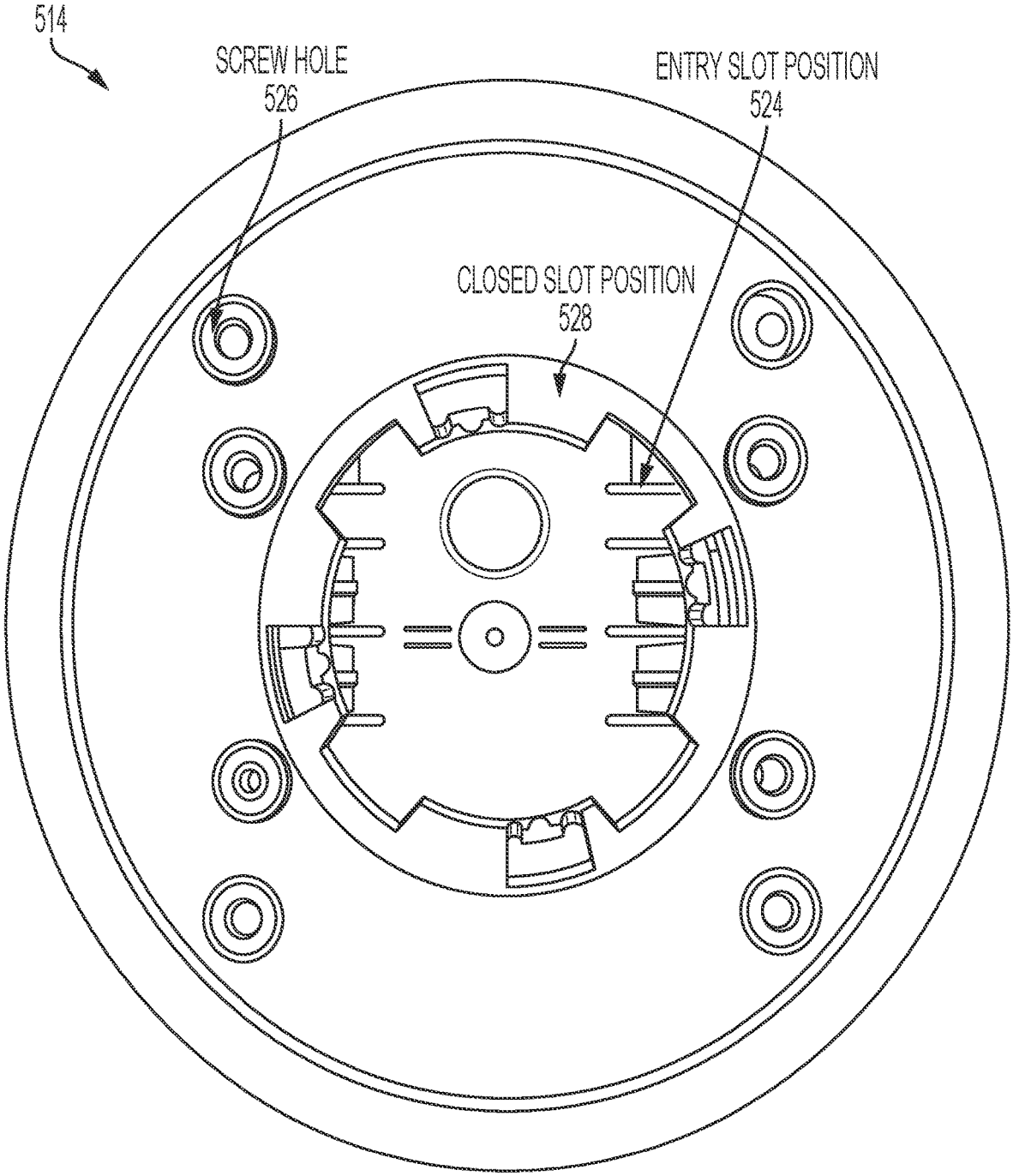
FIG. 6 illustrates a close-up perspective of the wall mount plate according to example embodiments.

FIG. 6 illustrates a close-up perspective of the wall mount plate according to example embodiments. Referring to FIG. 6, the configuration 514 provides a close-up view of the wall mount plate 514. The plate has a set of screw holes 526 used to mount the plate to an electrical box of a wall or ceiling. The plate has entry slot positions 524 and closed slot positions with tabs 528. In this example there are a set of four, however, there may be other configurations which have more or less slots and tabs to maintain the plate 514 in a locked position.

Figure 7A:
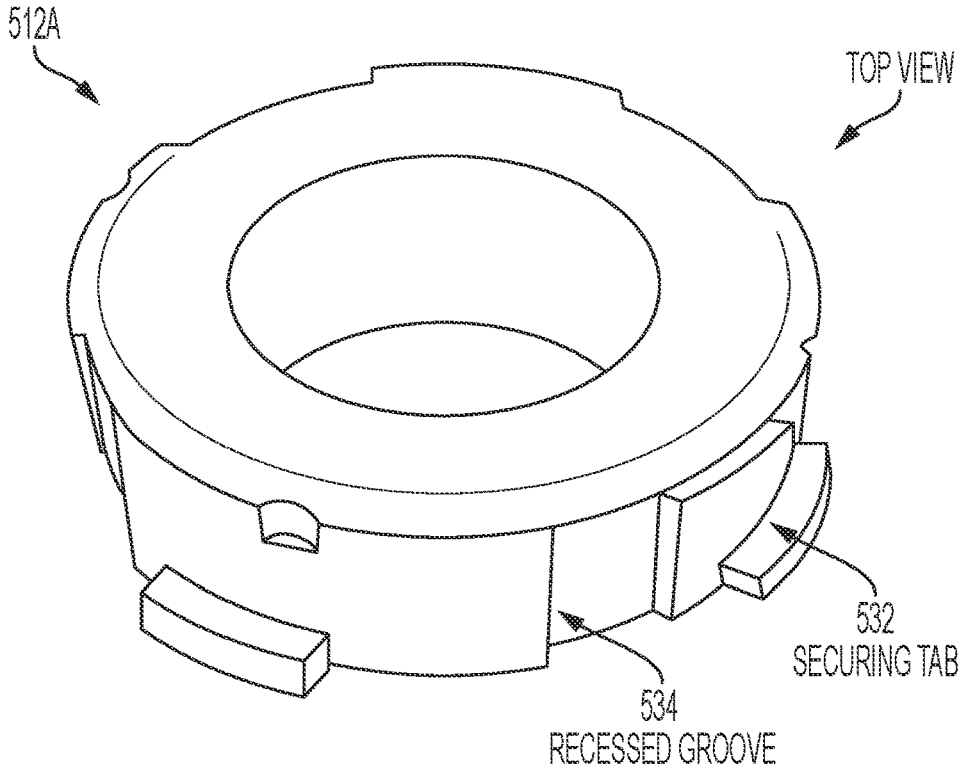
FIGS. 7A and 7B illustrate top and bottom perspectives of the wall mounting fitting.
Figure 7B:
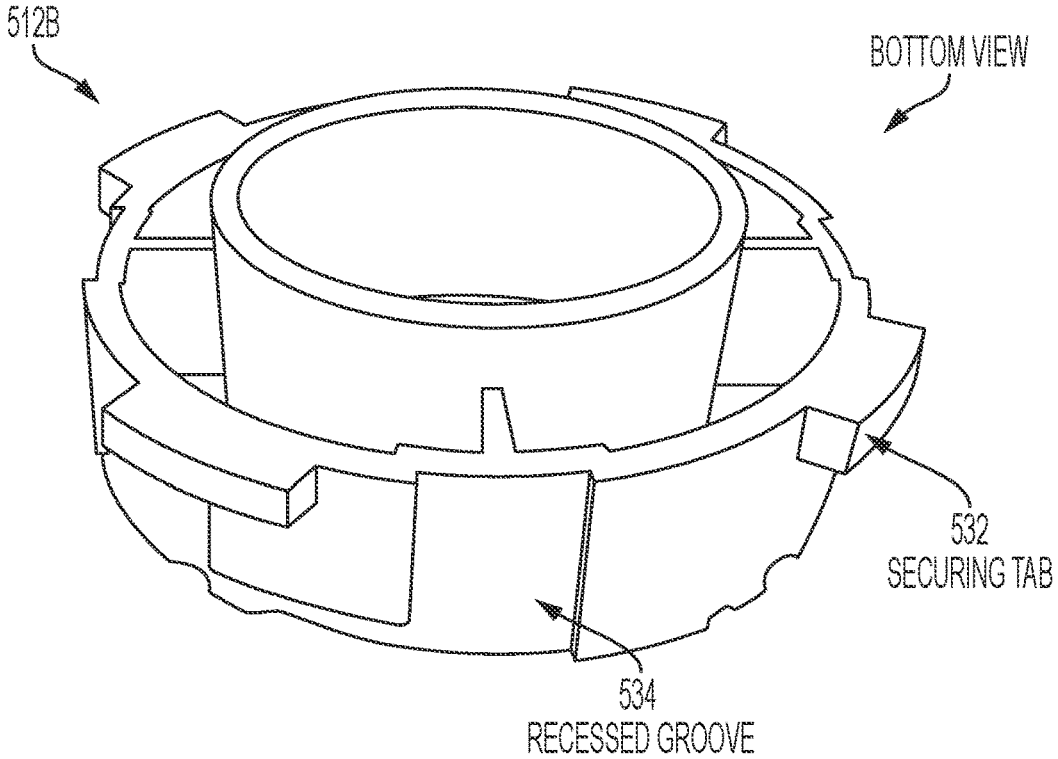

FIGS. 7A and 7B illustrate top and bottom perspectives of the wall mounting fitting. Referring to FIG. 7A, the wall mounting fitting top view 512A demonstrates the securing tabs 532 and recessed grooves 534 which are used to form-fit into the plate holes and tabs of the wall mount plate 514. The bottom view 512B shows the same elements of the wall mounting fitting in an upside down position.

Figure 8:
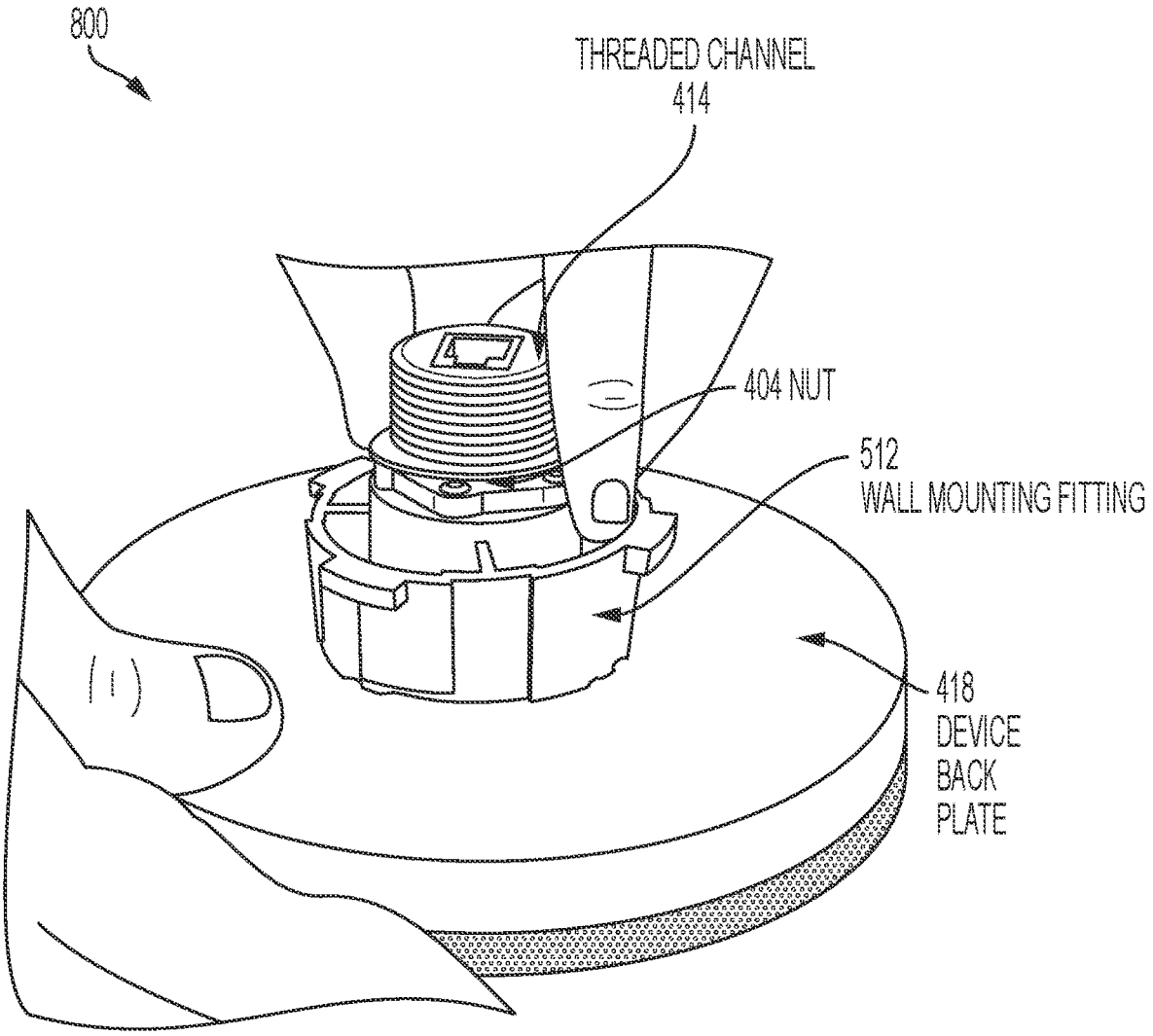
FIG. 8 illustrates a combined product example of the ceiling mount according to example embodiments.

FIG. 8 illustrates a combined product example of the ceiling mount according to example embodiments. Referring to FIG. 8, the configuration 800 demonstrates how the device housing (back plate 418) is affixed to the threaded channel 414, the nut 404 and the wall mounting fitting 512. The wall mounting fitting 512 can then be positioned and quarter turned into the wall mount plate 514.

One example device mount configuration for mounting to a table-top surface may include a support plate with a flat base portion and an elongated portion which extends perpendicular to the flat base portion, and a housing embodying one or more of a microphone and a speaker, and the housing backside includes a set of screw holes configured to receive a set of screws to secure the support plate flat base portion to be flush mounted against the housing. The elongated portion includes a threaded bolt with a hollow center. The elongated portion includes a slot opening that extends uniformly from a top of the threaded bolt to an outer surface area of the flat base portion to permit a cable to pass through the elongated portion into a recessed portion of housing. The device may also include a nut plate configured to screw onto a threaded surface of the elongated portion of the support plate. The nut plate may include a slot opening which extends from a center of the nut, which includes screw threads, to an exterior surface of the nut plate to provide a passage way for a cable to pass through into the elongated portion when the nut plate is screwed onto the elongated portion.

Another example embodiment may include a device that includes a housing backplate affixed to a housing which embodies one or more of a speaker and a microphone, a threaded channel affixed to the housing and extending perpendicular from the housing backplate, and a wall mount fitting with one or more securing tabs to hold the wall mount fitting to a wall mount plate. The wall mount plate is affixed to an electrical wall box via a plurality of screws. The wall mount fitting includes two or more of the securing tabs to hold the wall mount fitting to the wall mount plate when the wall mount fitting is inserted into the wall mount plate and turned to engage the two or more securing tabs in a closed slot position of the wall mount plate. The threaded channel includes a cable interface which connects a cable to wires attached to the speaker or microphone. The cable interface is a RJ-45 cable interface. The device may also include a nut to hold the wall mount fitting in place on the threaded channel. The one or more securing tabs may include four securing tabs. The wall mount plate may include four entry slots to receive the securing tabs and four closed slot positions to maintain a secure position of the securing tabs when the securing tabs are turned into a locked position.

It will be readily understood that the components of the application, as generally described and illustrated in the figures herein, may be arranged and designed in a wide variety of different configurations. Thus, the detailed description of the embodiments is not intended to limit the scope of the application as claimed but is merely representative of selected embodiments of the application.

One having ordinary skill in the art will readily understand that the above may be configured with hardware elements in configurations that are different than those which are disclosed. Therefore, although the application has been described based upon these preferred embodiments, it would be apparent to those of skill in the art that certain modifications, variations, and alternative constructions would be apparent.

While preferred embodiments of the present application have been described, it is to be understood that the embodiments described are illustrative only and the scope of the application is to be defined solely by the appended claims when considered with a full range of equivalents and modifications (e.g., materials, shapes, sizes, etc.) thereto.

What is claimed is:

1. An apparatus comprising:

a housing embodying one or more of a microphone and a speaker; and a support plate comprising a flat base portion and an elongated portion which extends perpendicular to the flat base portion and wherein the elongated portion comprises a threaded bolt with a hollow center, and a slot opening that extends uniformly from a top of the threaded bolt to an outer surface area of the flat base portion to permit an object to pass through the elongated portion into a recessed portion of the housing; and a nut plate screwed onto the threaded bolt of the elongated portion of the support plate, wherein the nut plate comprises a slot opening in a portion of a threaded center.

2. The apparatus of claim 1, wherein the housing comprises a backside with a set of screw holes configured to receive a set of screws to secure the support plate flat base portion to be flush mounted against the housing.

3. The apparatus of claim 1, wherein the slot opening which extends from the threaded center of the nut plate comprises screw threads, to an exterior surface of the nut plate.

4. The apparatus of claim 3, wherein the slot opening provides a passage way for a cable to pass through into the elongated portion when the nut plate is screwed onto the elongated portion.

* * * * *